US010174576B2

(12) United States Patent
Holtby et al.

(10) Patent No.: US 10,174,576 B2
(45) Date of Patent: Jan. 8, 2019

(54) WELL STRING STRIPPER AND STABILIZER

(71) Applicant: Katch Kan Holdings Ltd., Edmonton (CA)

(72) Inventors: Quinn A. J. Holtby, Edmonton (CA); Dallas Greenwood, Edmonton (CA)

(73) Assignee: Katch Kan Holdings Ltd., Edmonton (CA)

( * ) Notice: Subject to any disclaimer, the term of this patent is extended or adjusted under 35 U.S.C. 154(b) by 135 days.

(21) Appl. No.: 14/808,942

(22) Filed: Jul. 24, 2015

(65) Prior Publication Data

US 2017/0058629 A1 Mar. 2, 2017

(30) Foreign Application Priority Data

Jul. 22, 2015 (CA) ..... 2897999

(51) Int. Cl.
*E21B 33/08* (2006.01)
*E21B 17/10* (2006.01)

(52) U.S. Cl.
CPC ..... *E21B 33/08* (2013.01); *E21B 17/1078* (2013.01)

(58) Field of Classification Search
CPC ..... E21B 33/08; E21B 17/1078
See application file for complete search history.

(56) References Cited

U.S. PATENT DOCUMENTS 5,170,853 A * 12/1992 Mason ..... E21B 33/08 166/84.1
9,784,065 B2 10/2017 Holtby
2014/0124222 A1* 5/2014 Holtby ..... E21B 17/006 166/387
2015/0275625 A1* 10/2015 Machicek ..... E21B 37/02 166/173

FOREIGN PATENT DOCUMENTS

WO 2015/109411 A1 7/2015

OTHER PUBLICATIONS

Holtby, Q.A.J., "Apparatus and Method for Stripping Solids and Fluids From a String Used in Drilling or Servicing Wells," U.S. Appl. No. 15/706,054, filed Sep. 15, 2017.

* cited by examiner

*Primary Examiner* — Giovanna C. Wright
*Assistant Examiner* — Brandon M Duck
(74) *Attorney, Agent, or Firm* — Christensen O'Connor Johnson Kindness, PLLC

(57) ABSTRACT

A stabilizer for a pipe being removed from a well comprises a body formed of body segments where the body segments are separable to allow the body to open and be wrapped around the pipe. The stabilizer has a first annular seal formed by first seal elements within the body for receiving and stripping the pipe, and may have a second annular seal. The body segments may be hinged together about a hinge that may be configured to limit the movement of the body segments relative to each other. The hinge may comprise an interdigitated first and second row of fingers.

13 Claims, 4 Drawing Sheets

WELL STRING STRIPPER AND STABILIZER

TECHNICAL FIELD

The present disclosure is related to the field of apparatuses, in particular, stabilizers and pipe wipers for wiping fluids and solids off pipe sections of a string used in the drilling of a well, or in the servicing of a well, as the pipe sections are removed from the well.

BACKGROUND

As sections of pipe in a string used either on a drilling rig in the drilling of wells or on a service rig in the servicing of wells are removed from or "tripped out" of the well, they are often covered with solids and/or fluids. Before the pipe sections are put back into a storage rack or facility, it is desirable that the solids or fluids be removed or stripped off of the pipe. Known methods for removing solids or fluids from pipe sections being tripped out of a well are cumbersome and can be difficult, if not dangerous, for drilling personnel to use. Damage may also result as the pipe sections are tripped out of a well, from pipe sections colliding with obstructions in the well and with the sides of the well.

Known methods for removing solids or fluids from pipe sections being tripped out of a well include the manual use of rags and gunny sacks which require the hands of drilling personnel to be in close proximity to the drilling fluid. The drilling fluid is often at high temperatures and can burn the hands of drilling personnel. The known methods can result in the wiping device being dropped down into the drill hole.

It is, therefore, desirable to provide a stabilizer with pipe wiper and seal function that can wipe or strip off solids from pipe sections being tripped out of a well which prevents damage resulting from the drill pipe banging against the drill hole and is easy to handle by personnel on the well.

SUMMARY

An apparatus for stabilizing a string used in drilling of wells or used in the servicing of wells and for stripping solids and fluids from sections of pipe on a string is disclosed.

In an embodiment, there is disclosed a stabilizer for a pipe being removed from a well is disclosed comprising a body formed of body segments that together are shaped to be received in a rotary table, the body having a central axis, the body segments being separable to allow the body to open and be wrapped around the pipe; and a first annular seal formed by first seal elements within the body for receiving and stripping the pipe.

In a further embodiment, there is disclosed a stabilizer for a pipe being removed from a well, comprising a body formed of body segments that together are shaped to be wrapped around the pipe, a first annular seal formed by first seal elements for receiving and stripping the pipe, the first annular seal being located at an upper end of the body; and a second annular seal formed of second seal elements, the second annular seal being located at a lower end of the body, wherein the first annular seal has a first inner radius and the second annular seal has a second inner radius, and the second inner radius is smaller than the first inner radius.

In a further embodiment, there is disclosed a stabilizer for a pipe being removed from a well, comprising a body formed of body segments, the body having a central axis, the body segments being separable to allow the body to open and be wrapped around the pipe; and the body segments being hinged together about a hinge that is parallel to the central axis, the hinge comprising a first row of fingers formed as part of a first one of the body segments and a second row of fingers formed as part of a second one of the body segments, and the first row of fingers being interdigitated with the second row of fingers to form the hinge.

In a further embodiment, there is disclosed a stabilizer for a pipe being removed from a well, comprising a body formed of body segments, the body having a central axis, the body segments being hinged together about a hinge that is parallel to the central axis; and the hinge is configured to limit relative movement of the body segments about the central axis relative to each other.

In various embodiments, there may be included any one or more of the following features: the body has an exterior surface that tapers from a wider end forming an upper end of the body to a narrower end forming a lower end of the body; one or more handles extending from the upper end of the body; the first annular seal is located at an upper end of the body; a second annular seal formed of second seal elements, the second annular seal being located at a lower end of the body; the first annular seal has a first inner radius and the second annular seal has a second inner radius, and the second inner radius is smaller than the first inner radius; surfaces of the first seal elements that contact each other form planes with normals that are skewed relative to the central axis; surfaces of the second seal elements that contact each other form planes with normals that are skewed relative to the central axis; the body segments are hinged together about a hinge that is parallel to the central axis; the hinge is configured to limit relative movement of the body segments about the central axis relative to each other to less than 90 degrees; the hinge comprises a first row of fingers formed as part of a first one of the body segments and a second row of fingers formed as part of a second one of the body segments, and the first row of fingers being interdigitated with the second row of fingers to form the hinge; fingers of the first row of fingers are separated by sidewalls, and the sidewalls limit movement of the second row of fingers about the central axis; the body segments are connected opposite the hinge by a guide; the guide is formed of cooperating tongue and groove elements.

DETAILED DESCRIPTION OF EMBODIMENTS

For purposes of this specification and the claims contained herein, the term "string" is defined to include a drill string comprised of multiple sections of pipe joined together and used on a drilling rig for the drilling of wells, a string of pipe comprised of multiple sections of pipe joined together and used on a service rig for the servicing of wells, and coil tubing that is used in the directional drilling of wells in addition to the servicing of wells. For purposes of this specification and the claims contained herein, the term "rig" is defined to include both well drilling rigs and well servicing rigs as well as snubbing units, push/pull rigs, coil tubing units, and other mechanical devices used to insert or remove string from a well. A well comprises a borehole that penetrates the subsurface of the earth to access a fluid reservoir.

Figure 1:
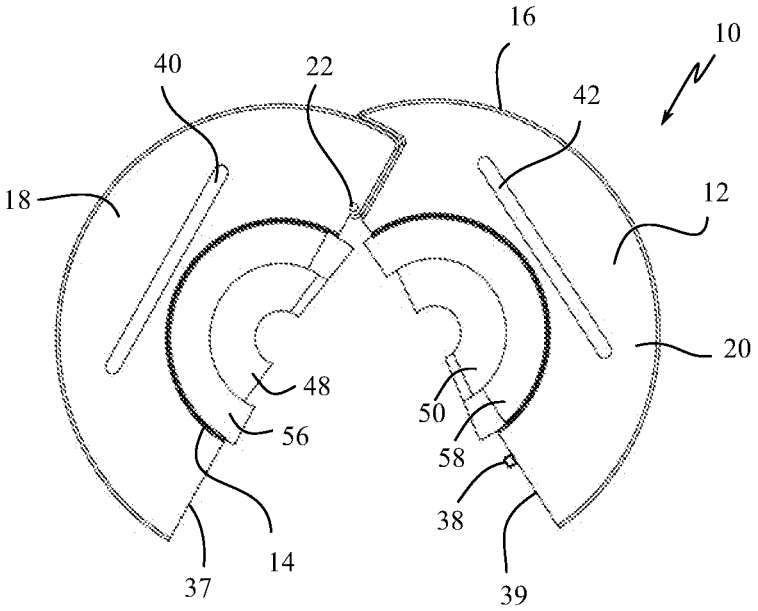
FIG. 1 is a top plan view depicting an embodiment of a stabilizer in an open position.
Figure 2:
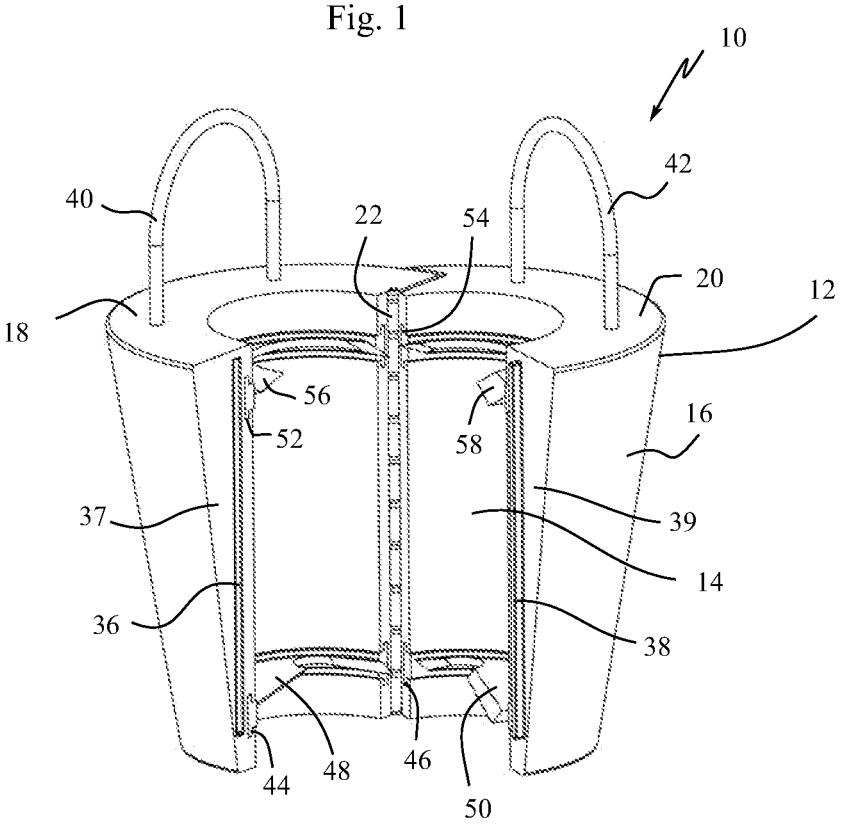
FIG. 2 is a perspective view depicting the stabilizer of FIG. 1.

Referring to FIGS. 1 and 2, an embodiment of stabilizer 10 is shown. In this embodiment, stabilizer 10 can comprise body 12 with a central axis 60 and shaped to be received in a rotary table. The body may have a generally cylindrical interior surface 14 forming a passage to receive a pipe (not shown) and an exterior surface 16 shaped to be received in a rotary table where the exterior surface 16 tapers from a wider end forming an upper end of the body to a narrower end forming a lower end of the body. The body 12 consists of arcuate or semicircular body segments 18 and 20 that are separable to allow the body 12 to open and be wrapped around the pipe.

Figure 3:
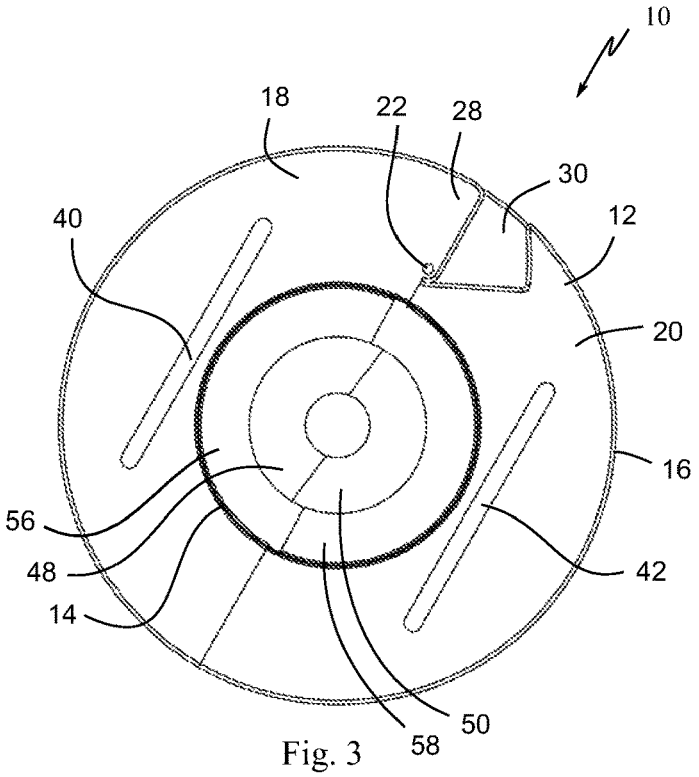
FIG. 3 is a top plan view depicting an embodiment of a stabilizer in a closed position.
Figure 4:
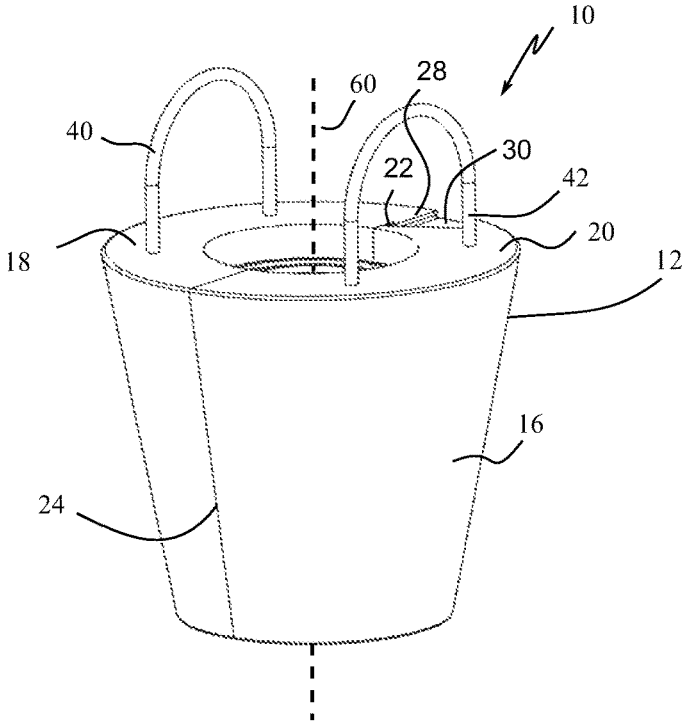
FIG. 4 is a perspective view depicting the stabilizer of FIG. 3.
Figure 5:
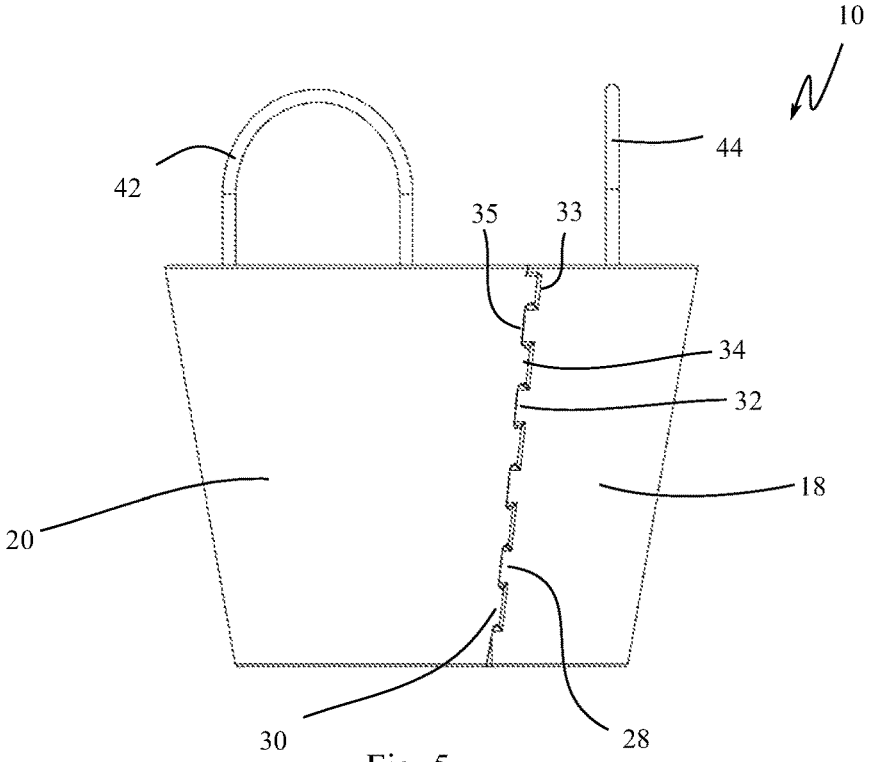
FIG. 5 is a side elevation view of the stabilizer of FIG. 1.
Figure 6:
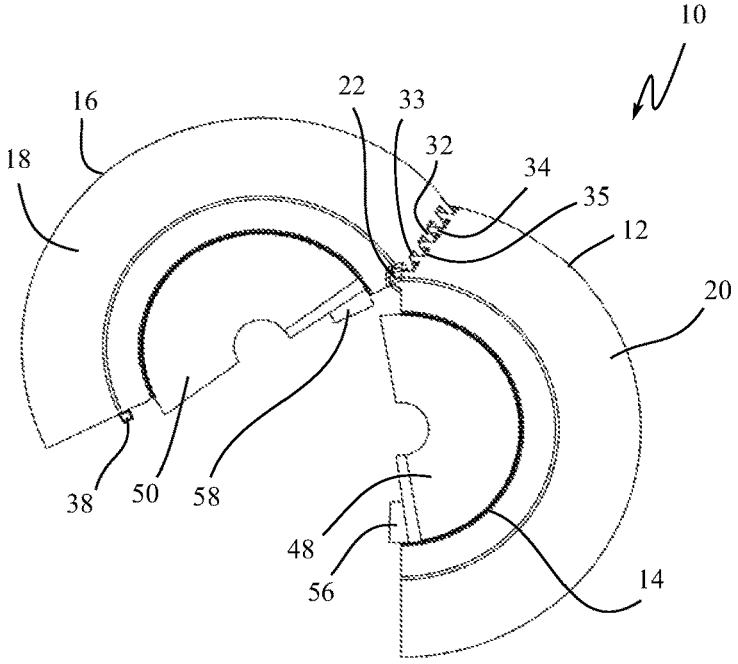
FIG. 6 is a bottom plan view depicting the stabilizer of FIG. 1.
Figure 7:
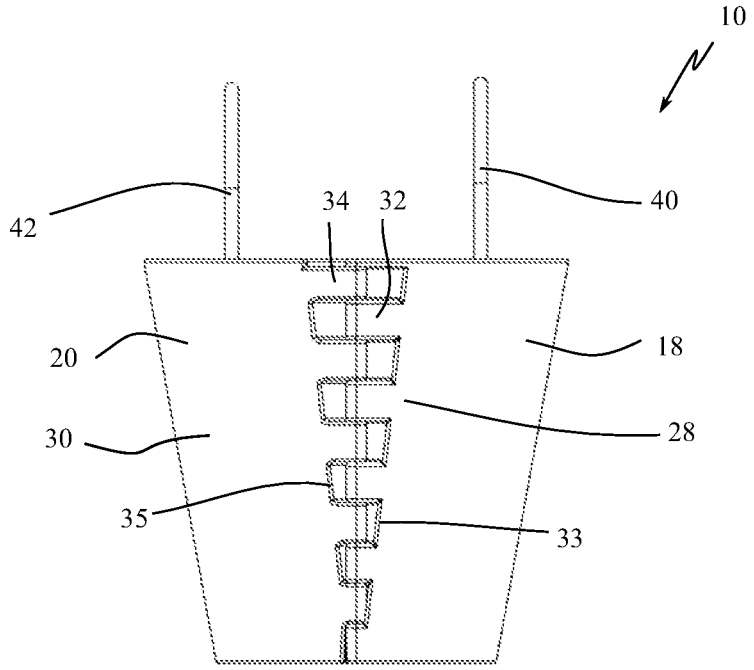
FIG. 7 is a side elevation view of the stabilizer of FIG. 3.
Figure 8:
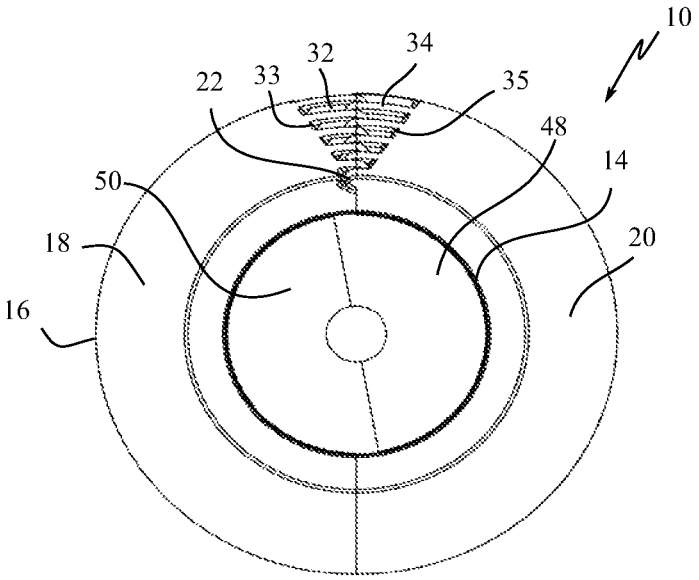
FIG. 8 is a bottom plan view depicting the stabilizer of FIG. 3.

As shown in FIGS. 3 and 4, when body segments 18 and 20 are closed together to meet at seam 24, body 12 defines interior 26 through which a drill string (not shown) can be placed and pass through. While this embodiment comprises two semi-circular body segments 18 and 20 to form cylindrical or tubular body 12, it should be understood that three or more arcuate body segments pivotally connected together can be used to form body 12. In other embodiments of stabilizer 10, body 12 can have a cross-sectional shape that is not circular, such shapes including: triangular, square, rectangular, oval and polygonal cross-sectional shapes. For the purposes of this specification and the claims contained herein, the terms "arcuate," "semi-circular," "cylindrical," "tubular" and any other like terms are hereby defined to include both circular and non-circular cross-sectional shapes of body 12 and parts therefor, including a sealing member that is disposed in body 12 and discussed in further detail below.

In use, the exterior surface 16 of body 12 engages a rotary table (not shown) while the substantially cylindrical interior surface 14 receives the pipe. As the exterior surface 16 of body 12 engages the rotary table, it prevents the pipe from moving sideways and hitting or otherwise being damaged by material surrounding the rotary table.

As shown in FIGS. 5-8, body segments 18 and 20 may be pivotally connected together with hinge 22 that may be parallel to the central axis. The hinge 22 is formed between circumferential end 28 of body half 18 and circumferential end 30 of body half 20. The hinge 22 allows the body halves 18 and 20 to open and close about an axis parallel to the central axis of the body 12. This permits stabilizer 10 to be installed and removed without complications arising from binding.

The hinge 22 may comprise a first row of fingers 32 formed as part of a first one of the body segments and a second row of fingers 34 formed as part of a second one of the body segments, as shown in FIGS. 5-8. The first row of fingers 32 may be interdigitated with the second row of fingers 34 to form the hinge 22.

The hinge 22 may be configured to limit the relative movement of the body segments about the central axis relative to each other, for example to less than 90 degrees. The first row of fingers 32 may be separated by sidewalls 33 that limit the movement of the second row of fingers 34 about the central axis and provide a limitation on the angle to which the hinge 22 may open. This may provide the user with increased control by only permitting the hinge 22 to open as much as is necessary to remove the stabilizer from the rotary table. The second row of fingers may be separated by sidewalls 35. Sidewalls 35 may limit the movement of the first row of fingers 32 to limit the movement of the body segments about the central axis relative to each other in combination with sidewalls 33.

As shown in FIGS. 1 and 2, the body segments may be connected opposite the hinge by a guide. The guide may have a cooperating groove 36 and tongue 38. The guide prevents the body segments 18 and 20 from twisting when the hinge 22 closes the body segments 18 and 20 together.

Body 12 can further comprise handle 40 extending from an upper end of body segment 18 and handle 42 extending from an upper end of body segment 20 so as to enable a person to grasp and hold onto stabilizer 10 when a string is raised through it. Handles 40 and 42 may also enable the stabilizer to be held securely in the rotary table.

As shown in FIGS. 1 and 2, the interior surface of body segment 18 and of body segment 20 may comprise respective first grooves 52 and 54 disposed thereon where first sealing elements 56 and 58 may be removably placed. The first sealing elements 56 and 58 form a first annular seal having a first inner radius within the body of stabilizer 10. The first annular seal may be located at the upper end of the body 12. The surfaces of the first seal elements that contact each other form planes with normals that may be skewed relative to the central axis. The interior surface of body segment 18 and of body segment 20 may further comprise respective second grooves 44 and 46 disposed thereon where second sealing elements 48 and 50 may be removably placed. Second sealing elements 48 and 50 form a second annular seal having a second inner radius, which may be smaller than the first inner radius, within the body 12. The second annular seal may be located at the lower end of the body 12. The surfaces of the second seal elements 48 and 50 that contact each other form planes with normals that may be skewed relative to the central axis. Grooves 44, 46, 52 and 54 enable the easy installation and removal of sealing elements 48, 50, 56 and 58 in body segments 18 and 20 so that the sealing elements can be replaced when they becomes damaged or when a sealing element for a different diameter pipe is required. First sealing elements 56 and 58 may form a first stripper or seal for removing larger and thicker debris from the drill string, while second sealing elements 48 and 50 may form a second stripper or seal for removing any remaining debris and fluids from the drill string.

Sealing elements 48, 50, 56 and 58 can be made of any suitable elastomeric material that enables sealing elements 48, 50, 56 and 58 to flex and stretch so as to maintain contact with the external surface of a pipe (not shown) due to any irregularities to the cross-sectional shape of the pipe or to the contour of the pipe's external surface and, in addition, to allow the opening to expand in diameter so as to enable any joint connection between two sections of pipe to pass through sealing elements 48, 50, 56 and 58 as a joint connection can have a larger diameter than the diameter of the pipe itself. Suitable examples of the elastomeric material for sealing elements 48, 50, 56 and 58 can include natural rubber, neoprene rubber, foam rubber, silicone based rubber, nitrile rubber and any other material that is suitable for use as a seal that can be used to strip petroleum-based substances from a string. The elastomeric material for sealing elements 48, 50, 56 and 58 can also be a low weight material which would allow sealing elements 48, 50, 56 and 58 to float on the drilling fluid if sealing elements 48, 50, 56 and 58 were dropped into well.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

The embodiments of the invention in which an exclusive property or privilege is claimed are defined as follows:

1. A stabilizer for a pipe being removed from a well, comprising:

a body formed of body segments that together are received in a rotary table, the body having a central axis, the body segments being separable to allow the body to open and be wrapped around the pipe;

the body having an exterior surface that tapers from a wider end forming an upper end of the body to a narrower end forming a lower end of the body;

a first annular seal formed by first seal elements within the body for receiving and stripping the pipe, the first annular seal being located at an upper end of the body; and a second annular seal formed of second seal elements, the second annular seal being located at a lower end of the body.

2. The stabilizer of claim 1 further comprising one or more handles extending from the upper end of the body.

3. The stabilizer of claim 1 in which the first annular seal has a first inner radius and the second annular seal has a second inner radius, and the second inner radius is smaller than the first inner radius.

4. The stabilizer of claim 1 in which surfaces of the first seal elements that contact each other form planes with normals that are skewed relative to the central axis.

5. The stabilizer of claim 1 in which surfaces of the second seal elements that contact each other form planes with normals that are skewed relative to the central axis.

6. The stabilizer of claim 1 in which the body segments are hinged together about a hinge that is parallel to the central axis.

7. The stabilizer of claim 6 in which the hinge is configured to limit relative movement of the body segments about the central axis relative to each other to less than 90 degrees.

8. The stabilizer of claim 6 in which the hinge comprises a first row of fingers formed as part of a first one of the body segments and a second row of fingers formed as part of a second one of the body segments, and the first row of fingers being interdigitated with the second row of fingers to form the hinge.

9. The stabilizer of claim 8 in which fingers of the first row of fingers are separated by sidewalls, and the sidewalls limit movement of the second row of fingers about the central axis.

10. The stabilizer of claim 6 in which the body segments are connected opposite the hinge by a guide.

11. The stabilizer of claim 10 in which the guide is formed of cooperating tongue and groove elements.

12. A stabilizer for a pipe being removed from a well, comprising: a body formed of body segments that together are received in a rotary table, the body having a central axis, the body segments being separable to allow the body to open and be wrapped around the pipe; and the body segments being hinged together about a hinge that is parallel to the central axis, the hinge comprising a first row of fingers formed as part of a first one of the body segments and a second row of fingers formed as part of a second one of the body segments, and the first row of fingers being interdigitated with the second row of fingers to form the hinge, and the fingers being configured to move circumferentially relative to each other about the central axis when the body is opened.

13. The stabilizer of claim 12 in which fingers of the first row of fingers are separated by sidewalls, and the sidewalls limit movement of the second row of fingers about the central axis.

* * * * *